US005535647A

United States Patent [19]

Donaldson, Jr.

[11] Patent Number: 5,535,647

[45] Date of Patent: Jul. 16, 1996

[54] FRICTION CLUTCH WRENCH

[75] Inventor: Robert D. Donaldson, Jr., Dallas, Tex.

[73] Assignee: Three Star Enterprises, Inc., Savannah, Ga.

[21] Appl. No.: 246,508

[22] Filed: May 20, 1994

[51] Int. Cl.[6] ..... B25B 13/00

[52] U.S. Cl. ..... 81/59.1; 81/90.6; 81/426.5

[58] Field of Search ..... 81/60, 59.1, 58, 81/58.2, 90.1, 90.3, 90.6, 424.5, 426.5, 315, 318, 342, 418

[56] References Cited

U.S. PATENT DOCUMENTS

| | | | |
|---|---|---|---|
| 1,412,688 | 4/1922 | Layton | 81/59.1 |
| 2,209,988 | 8/1940 | Matlock | 81/90.6 |
| 2,613,566 | 10/1952 | Hadley | 81/319 |
| 2,730,000 | 1/1956 | Crittenden | 81/179 |
| 3,662,867 | 5/1972 | Kinzbach | 81/59.1 |
| 3,927,582 | 12/1975 | Hertelendy | 81/58.2 |
| 4,770,070 | 9/1988 | Sowers | 81/418 |
| 5,249,487 | 10/1993 | Armfield | 81/58 |

FOREIGN PATENT DOCUMENTS

| | | | |
|---|---|---|---|
| 23287 | 10/1907 | Sweden | 81/58 |

*Primary Examiner*—Bruce M. Kisliuk
*Assistant Examiner*—Joni B. Danganan
*Attorney, Agent, or Firm*—Fulbright & Jaworski

[57] ABSTRACT

A friction clutch wrench in the style of locking grip pliers for imparting torsion to an object. Jaws open to access the work from the side, and then close and lock rigidly around the work. Once locked inside the jaws, the work engages a friction clutch ratchet mechanism provided in the confronting jaw faces. When the wrench is turned in one direction about the work, the friction clutch grips the work and imports torsion to it. When the wrench is rotated in the other direction, however, the friction clutch permits free rotation of the wrench about the work.

10 Claims, 4 Drawing Sheets

FRICTION CLUTCH WRENCH

BACKGROUND OF THE INVENTION

This invention relates to a friction clutch wrench for use in applying torsion to objects of a predefined range of size and cross-sectional shape. The jaws open and then close to engage an object within the operating ranges of the wrench. Once the jaws are engaged on the work, the friction clutch gripping mechanism in the jaws allows unidirectional torsion to be applied in a stepless ratchet technique. The preferred embodiment herein will operate equally well on conventional threaded hexagonal fasteners, or on the outside surfaces of cylindrical objects such as sockets or pipes. The effective operation of this invention is not limited to these cross-sectional shapes, however. This design will operate satisfactorily on any object whose cross-sectional size and shape will engage properly on the friction clutch mechanism provided in the jaws.

The basic friction clutch ratchet mechanism in the jaws was disclosed as early as 1923, in U.S. Pat. No. 1,412,688 issued to hymn and Hopkins. Until now, however, improvements on this technology have been limited to closed-ended devices, where the wrench is required either to be slipped over one end of the object to be turned, or to be connected axially to one end of the object by a means such as a square drive. See, e.g., Anaha, U.S. Pat. No. 2,896,488; Chern, U.S. Pat. No. 4,987,802; Headen, U.S. Pat. No. 4,603,606. Previous friction clutch ratchet mechanisms in open-ended wrenches have provided localized grip only, and have provided minimal flexibility in terms of the size of the fastener or component that the wrench will operate on. See, e.g., Crittenden, U.S. Pat. No. 2,730,000; Hertelendy, U.S. Pat. No. 3,927,582. The locking grip pliers mechanism used to close and lock the jaws on the present invention is well known in the art.

The present invention thus improves on the prior art to produce a wrench design that is apparently unknown in the art. Much like an open-ended wrench, its open jaws provide access to fasteners and components from the side. Once closed and locked over the work, however, the wrench assumes the strength and rigidity of a closed-ended wrench while providing an all-round stepless ratchet grip.

SUMMARY OF THE INVENTION

As noted, one object of this invention is to combine the accessibility of an open-ended ratchet wrench with the all-round grip, strength and rigidity of a closed-ended wrench.

Another object is to provide a wrench capable of operating on objects within a range of sizes and cross-sectional shapes, instead of just one specific size and/or shape per tool as is common in the art. The preferred embodiment herein will operate on a range dictated by the taper formed into the notches in the jaw faces. The wrench will provide its widest ratchet grip when the rollers are forced into their deepest position within the notches. Conversely, the wrench will cease to grip once the rollers can no longer make contact with the work even though they are at the top of their tapered notches. The wrench will thus operate uniformly whenever the rollers are engaged between these two extremes.

A further object is to provide a wrench that, unlike conventional pipe wrenches or locking grip pliers, minimizes damage to the surface of the work at the points of contact. The all-round grip provided by this wrench improves on the localized grip offered by such tools. Further, the present invention presents the smooth surface of its rollers at the points of contact with the work. These rollers will cause less damage to the surface of the work than the sharp knurls or teeth employed by the jaws of similar tools to anchor a grip on the work.

These and other objects of the present invention will be apparent to those skilled in this art from the derailed description of a preferred embodiment of the invention set forth below.

BRIEF DESCRIPTION OF THE DRAWINGS

The invention will be further described in connection with the accompanying drawings, in which:

FIG. 5 also shows a cross-section through the arcuate slots at which the roller cages are slidably connected to the jaw assemblies. In this view, the fastener means making this attachment are partially omitted/or clarity.

DETAILED DESCRIPTION OF THE INVENTION

Figure 1:
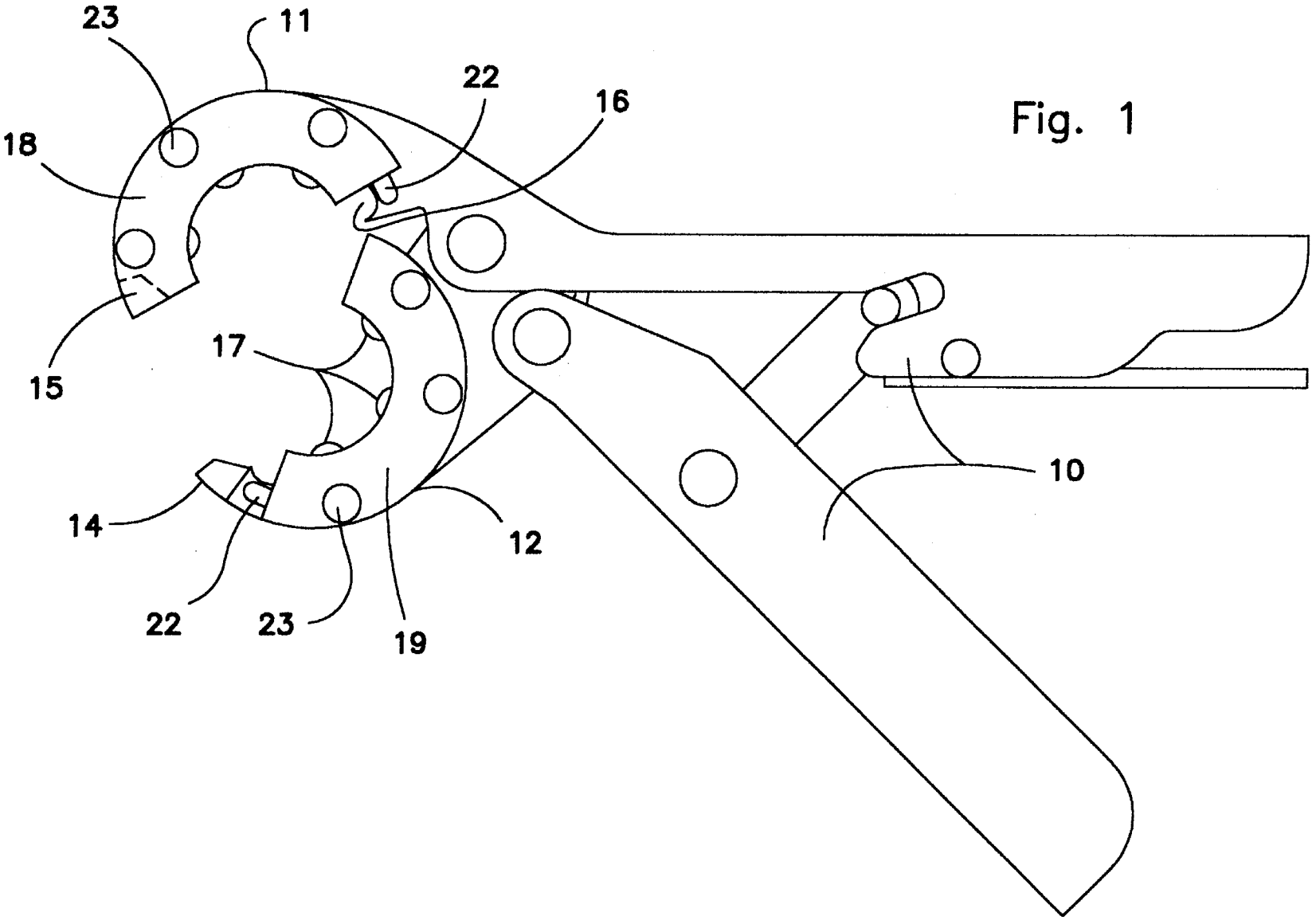
FIG. 1 is an overhead view of the wrench, showing the jaws open and ready to receive work.
Figure 2:
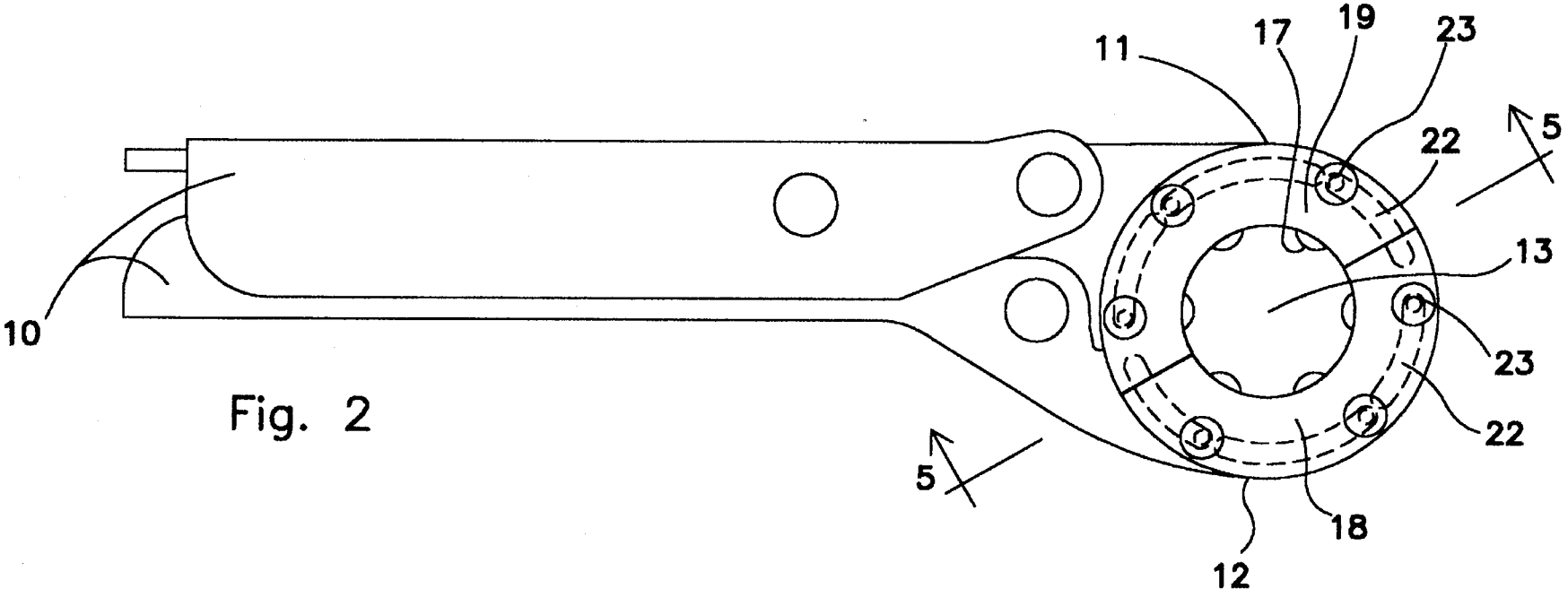
FIG. 2 is another overhead view of the wrench, showing the jaws closed and locked.
Figure 3:
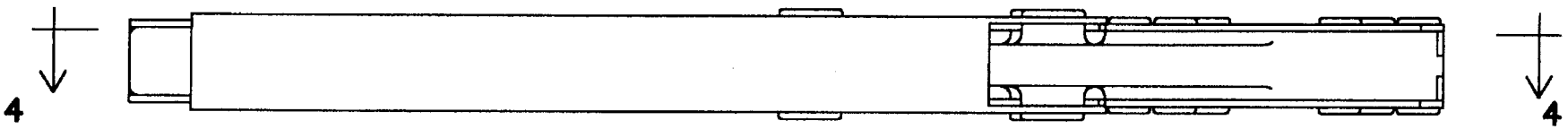
FIG. 3 side view of the wrench as shown on FIG. 2.

As can be seen generally in FIG. 1 and FIG. 2, handles 10 operate to open, close and lock upper jaw assembly 11 and lower jaw assembly 12 together in accordance with conventional locking grip pliers technology. When closed and locked, jay assemblies 11 and 12 meet to form a substantially continuous circular opening 13 between them. FIG. 1 and FIG. 2 show that as jaw assemblies 11 and 12 are brought together, tapered locating lug 14 enters locating recess 15 in jaw opposite, guiding and holding jaw assemblies 11 and 12 together.

Figure 4:
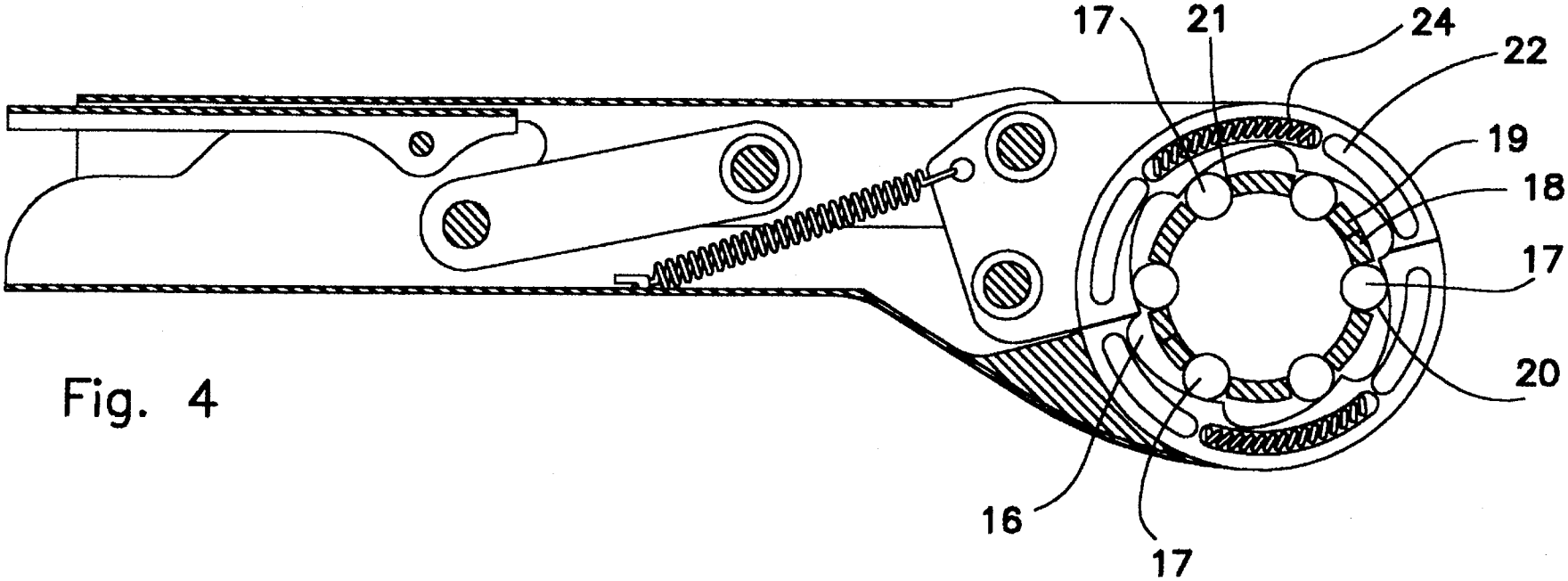
FIG. 4 is a section through the wrench as shown on FIG. 3, showing the internal components of the upper and lower jaw assemblies. The tops of the upper and lower roller cages are cut away in this view, and the fastener means attaching the roller cages to the jaw assemblies at the arcuate slots are omitted for clarity. The tapered locating lug received into its matching locating recess is also omitted for clarity.
Figure 6:
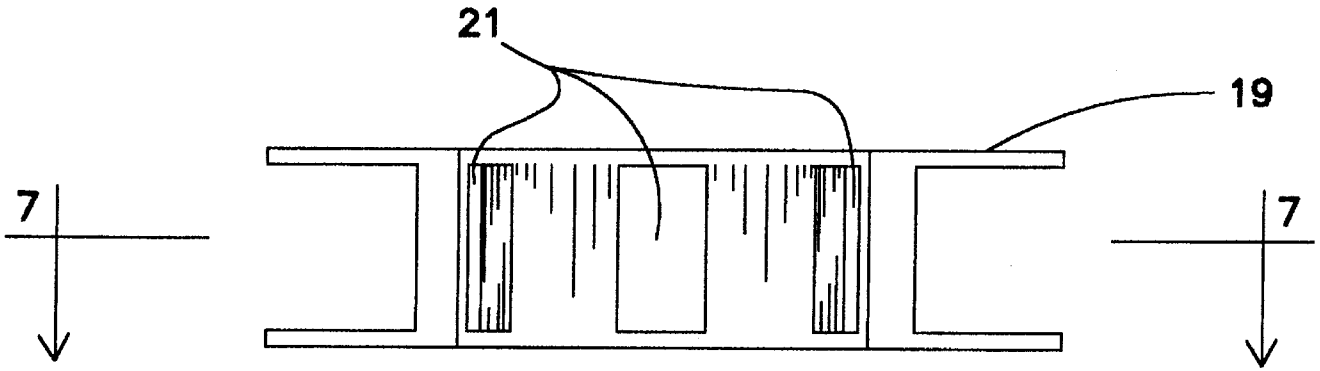
FIG. 6 is a similar view to FIG. 5, except that the roller cage is shown in isolation, with all other components stripped away.
Figure 7:
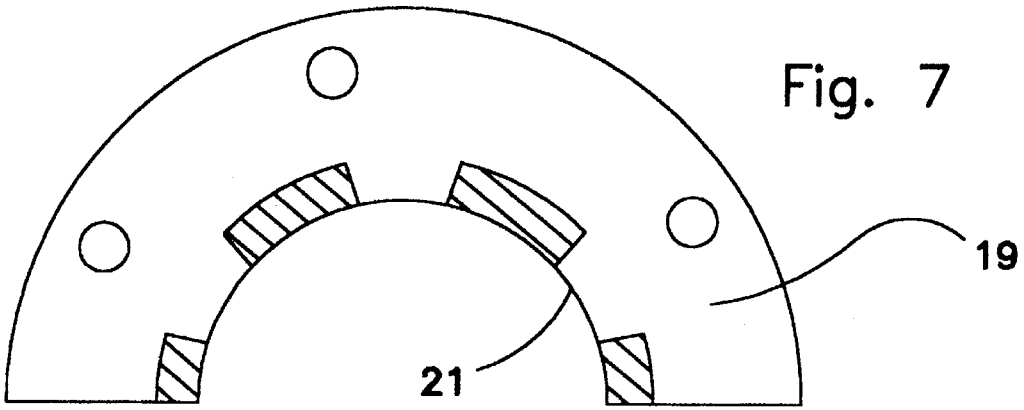
FIG. 7 is a sectional overhead view of the roller cage in isolation as shown on FIG. 6.

As shown in the sectional view of FIG. 4, the confronting jaw faces of jaw assemblies 11 and 12 each provide tapered notches 16. Rollers 17 are received into tapered notches 16, one roller received into each tapered notch. Upper roller cage 18 and lower roller cage 19 hold rollers 17 captive in tapered notches 16, but allow rollers 17 to protrude partially through upper cage openings 20 and lower cage openings 21. FIG. 6 and FIG. 7 show lower roller cage 19 in isolation from the side and in section from overhead, and also show cage openings 21.

Figure 5:
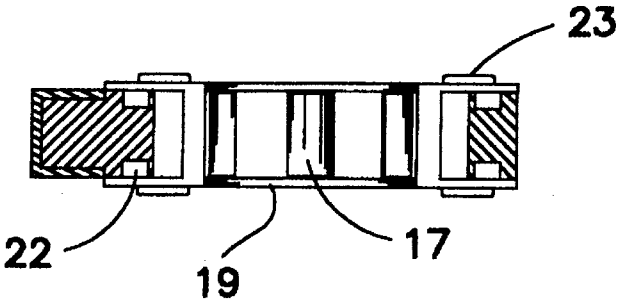
FIG. 5 is a section through the wrench as also shown on FIG. 2, showing the rollers being held captive by the roller cage while still protruding through the openings therein.

Returning to FIG. 4, jaw assemblies 11 and 12 also provide arcuate slots 22. When jaw assemblies 11 and 12 are closed, arcuate slots 22 combine to define a circle sharing a common center with circular inside opening 13. Upper and lower roller cages 18 and 19 are slidably connected to upper and lower jaw assemblies 11 and 12 respectively by conventional fastener means 23, such as rivets, at arcuate slots 22. FIG. 5 shows roller cage 19 assembled over arcuate slots 22, with fastener means 23 partially omitted for clarity. FIG. 4 also omits fastener means 23 for clarity. FIG. 7 shows, however, the holes within roller cages 19 through which fastener means 23 are received to connect at arcuate slots 22. FIG. 1 and FIG. 2 also show fastener means 23 as assembled.

Referring again to FIG. 4, at least one arcuate slot 22 on each of jaw assemblies 11 and 12 receives a conventional spring means 24. Spring means 24 are positioned within arcuate slots 22 so as to normally push on fastener means 23 and thus tend to cause upper and lower roller cages 18 and 19 to hold rollers 17 captive at their shallowest position within tapered notches 16.

A rest position for the wrench is thus achieved as spring means 24 cause upper and lower roller cages 18 and 19 to allow rollers 17 to protrude their furthest through roller cage openings 20 and 21. As jaw assemblies 11 and 12 are closed around the work, rollers 17 roll deeper into tapered notches 16 and rotate upper and lower cages 18 and 19 against spring means 24, until rollers 17 find a neutral position within tapered notches 16 at which they are in simultaneous contact with the outside surface of the work. Then, when the wrench is turned in one direction about the work, rollers 17 roll out of tapered notches and wedge tight against the outside surface of the work, effecting a friction grip on the work. Conversely, when the wrench is rotated in the other direction about the work, rollers 17 roll deeper into tapered notches 16 and allow free rotation of the wrench.

I claim:

1. A friction clutch wrench, comprising:

an upper jaw assembly and a lower jaw assembly with confronting jaw faces, each jaw assembly connected to an operating means, the operating means permitting the confronting jaw faces to be opened apart and brought together, the confronting jaw faces combining to define a substantially continuous circular inside opening when brought into close proximity;

at least one arcuate slot formed into each of the upper and lower jaw assemblies, the arcuate slots combining to define a circle sharing a common center with the circular inside opening;

at least one tapered notch formed into each confronting jaw face, the tapered notches extending across the thickness of the jaw faces;

a plurality of rollers, one roller received into each tapered notch;

an upper roller cage, the upper roller cage having one upper cage opening for each tapered notch in the upper jaw assembly, the upper cage opening allowing the roller received into its tapered notch to protrude through the upper cage opening while being held captive;

a lower roller cage, the lower roller cage having one lower cage opening for each tapered notch in the lower jaw assembly, the lower cage opening allowing the roller received into its tapered notch to protrude through the lower cage opening while being held captive;

a plurality of fastener means, the fastener means slidably connecting the upper and lower roller cages to the upper and lower jaw assemblies respectively at the arcuate slots;

a plurality of spring means, one spring means received into at least one arcuate slot in the upper jaw assembly and into at least one arcuate slot in the lower jaw assembly, the spring means bearing on the fastener means and tending to position the upper and lower roller cages to maintain the rollers at the shallowest tapered notch depth; and a male locating lug protruding from one confronting jaw face and a corresponding female locating recess provided in the other confronting jaw face, the male locating lug positioned directly opposite its corresponding female locating recess, the male locating lug also having a predetermined shape, the female locating recess having an internal shape that matches the predetermined shape of the male locating lug;

whereby, when the confronting jaw faces are brought together around an object, the locating lug guides the jaw faces into a predetermined relative position, and the rollers ratchet grip the outside surface of the object by wedging tight within their tapered notches when the wrench is turned one way about the object, while permitting free relative movement of the object when the wrench is turned the other way.

2. In combination with work to which torsion is desired to be applied, a friction clutch wrench, comprising:

a pliers, the pliers having a jaw operating means connected to an upper jaw assembly and a lower jaw assembly, the upper and lower jaw assemblies having confronting jaw faces;

the upper and lower jaw assemblies also each having disconnected first ends, the disconnected first ends both located remote from the jaw operating means, the disconnected first ends capable of being separated by the jaw operating means and then being brought together by the jaw operating means to allow the upper and lower jaw assemblies to be closed around the work; and a toothless ratchet gripping means, the toothless ratchet gripping means enabled by the closure of upper and lower jaw assemblies around the work, the toothless ratchet gripping means also including one or more taped notches, the toothless ratchet gripping means encouraged to assume a rest position at a shallow end of said tapered notches;

whereby the toothless ratchet gripping means allows the wrench to impart torsion to the work when turned in one direction, and to rotate freely about the work when turned in the other direction.

3. The friction clutch wrench of claim 2, wherein the jaw operating means also includes a means for locking and subsequently releasing the upper and lower jaw assemblies in a range of predetermined relative positions.

4. The friction clutch wrench of claim 2, further comprising jaw locating means, whereby the upper and lower jaw assemblies, when brought together by the jaw operating means, are guided into a predetermined relative position and held there.

5. The friction clutch wrench of claim 4, wherein the jaw locating means includes:

a male locating lug protruding from one confronting jaw face and a corresponding female locating recess provided in the other confronting jaw face, the male locating lug positioned directly opposite its corresponding female locating recess, the male locating lug also having a predetermined shape, the female locating recess having an internal shape that matches the predetermined shape of the male locating lug;

whereby, when the upper and lower jaw assemblies are brought together around the work, the locating lug guides the upper and lower jaw assemblies into a predetermined relative position.

6. The friction clutch wrench of claim 2, wherein the confronting jaw faces define a substantially continuous circular inside opening when brought into close proximity.

7. The friction clutch wrench of claim 6, wherein the toothless ratchet gripping means includes:

at least one arcuate slot formed into each of the upper and lower jaw assemblies, the arcuate slots combining to define a circle sharing a common center with the circular inside opening, the one or more tapered notches comprising at least one tapered notch formed into each confronting jaw face, the tapered notches extending across the thickness of the jaw faces;

a plurality of rollers, one roller received into each tapered notch;

an upper roller cage, the upper roller cage having one upper cage opening for each tapered notch in the upper jaw assembly, the upper cage opening allowing the roller received into its tapered notch to protrude through the upper cage opening while being held captive;

a lower roller cage, the lower roller cage having one lower cage opening for each tapered notch in the lower jaw assembly, the lower cage opening allowing the roller received into its tapered notch to protrude through the lower cage opening while being held captive;

fastener means, the fastener means slidably attaching the upper and lower roller cages to the upper and lower jaw assemblies respectively through the slots; and spring means, the spring means tending to maintain the rollers at the shallowest tapered notch depth;

whereby, when the upper and lower jaw assemblies are brought together by the jaw operating means around the work, the rollers engage the outside surface of the work, gripping the work by wedging tight within their notches when the wrench is turned one way about the work, but permitting free relative movement of the work when the wrench is turned the other way.

8. The friction clutch wrench of claim 7, wherein the spring means further comprises:

a plurality off slot springs, one slot spring received into at least one arcuate slot in the upper jaw assembly and into at least one arcuate slot in the lower jaw assembly, the slot springs bearing on the fastener means;

whereby the slot springs tend to position the upper and lower roller cages to maintain the rollers at the shallowest tapered notch depth.

9. A method of imparting unidirectional torsion about work, comprising the steps of:

providing a pliers with jaws, the jaws having disconnected remote ends and confronting faces;

providing a toothless ratchet gripping means on the confronting faces of the jaws, said toothless ratchet gripping means including one or more tapered notches;

encouraging the toothless ratchet gripping means to assume a rest position at a shallow end of said tapered notches;

opening the pliers to receive the work between the disconnected remote ends of the jaws, the size and cross-sectional shape of the work being within the operational range of the ratchet gripping means;

closing and locking the pliers around the work;

engaging the ratchet gripping means on the outside surface of the work; and turning the wrench about the work;

whereby the wench grips the work when it is turned in one direction, but allows free rotation when it is turned in the other direction.

10. The method of imparting unidirectional torsion about work of claim 9, further comprising the steps of:

equipping the pliers with a means for locking and subsequently releasing the jaws in a range of predetermined relative positions; and locking the jaws once the toothless ratchet gripping means is engaged on the outside surface of the work.

* * * * *